US005893406A

United States Patent [19]

Brophy

[11] Patent Number: 5,893,406

[45] Date of Patent: Apr. 13, 1999

[54] REGENERATIVE HEAT EXCHANGER

[75] Inventor: Mark E. Brophy, Wellsville, N.Y.

[73] Assignee: ABB Air Preheater, Inc., Wellsville, N.Y.

[21] Appl. No.: 08/969,601

[22] Filed: Nov. 13, 1997

[51] Int. Cl.[6] ..... F23L 15/02

[52] U.S. Cl. ..... 165/8; 165/10; 165/6

[58] Field of Search ..... 165/10, 9, 8, 6, 165/4

[56] References Cited

U.S. PATENT DOCUMENTS

| | | | |
|---|---|---|---|
| 4,552,204 | 11/1985 | Bellows | 165/8 X |
| 4,557,318 | 12/1985 | Bellows | 165/8 X |
| 4,561,492 | 12/1985 | Bellows | 165/8 |
| 4,606,400 | 8/1986 | Rhodes | 165/10 |
| 4,739,822 | 4/1988 | Mergler | 165/8 X |
| 4,789,024 | 12/1988 | Muscato | 165/8 X |
| 4,838,342 | 6/1989 | Goetschius | 165/8 X |
| 5,048,595 | 9/1991 | Harder | 165/10 X |
| 5,119,885 | 6/1992 | Johnson | 165/10 X |
| 5,485,877 | 1/1996 | Brophy | 165/8 |

*Primary Examiner*—Ira S. Lazarus
*Assistant Examiner*—Christopher Atkinson
*Attorney, Agent, or Firm*—Alix, Yale & Ristas, LLP

[57] ABSTRACT

Modular heat exchange baskets for rotary regenerative air preheaters have radially extending tie bars which are positioned at each of the top and bottom side edges of the basket and which tie together the inboard and outboard end frames. These tie bars are located inside of the side edges of the heat exchange plates such that the plates extend out beyond the tie bars. This reduces the bypass gap between baskets.

3 Claims, 4 Drawing Sheets

REGENERATIVE HEAT EXCHANGER

BACKGROUND OF THE INVENTION

The present invention relates generally to rotary heat regenerative heat exchangers and, more specifically, to improved modular heat exchange baskets.

A rotary regenerative heat exchanger is employed to transfer heat from one hot gas stream, such as a flue gas stream, to another cold gas stream, such as combustion air. The rotor contains a mass of heat absorbent material which is first positioned in a passageway for the hot gas stream where heat is absorbed by the heat absorbent material. As the rotor turns, the heated absorbent material enters the passageway for the cold gas stream where the heat is transferred from the absorbent material to the cold gas stream.

In a typical rotary heat exchanger, such as a rotary regenerative air preheater, the cylindrical rotor is disposed on a vertical central rotor post and divided into a plurality of sector-shaped compartments by a plurality of radial partitions or diaphragms extending from the rotor post to the outer peripheral shell of the rotor. These sector-shaped compartments are loaded with modular heat exchange baskets which contain the mass of heat absorbent material commonly comprised of stacked plate-like elements.

The rotor is surrounded by a housing and the ends of the rotor are partially covered by sector plates located between the gas inlet and outlet ducts which divides the housing into hot gas and cold gas sides. In order to improve the efficiency of operation, it is conventional to provide seals, which are referred to as radial seals, on the ends of the rotor such that the seals will come into proximity with the sector plates and minimize the flow of gases between the hot and cold sides at the ends of the rotor. These seals are normally attached to the edges of the diaphragms.

One type of modular heat exchange basket is disclosed in U.S. Pat. No. 5,485,877 in which the rotor is constructed for the loading and removal of the baskets in a radial direction through the side of the rotor. The baskets are positioned and supported in each sector so that they also act as supports between diaphragms and serve to stiffen the rotor structure while reducing bypass gaps. The baskets are supported on gratings fixed between diaphragms at each end of the rotor and between layers of baskets and the angle of each rotor sector is smaller than the complimentary angle of each basket such that the outboard end of each basket can contact the diaphragms before the contact of the inboard end.

The prior art basket designs, such as shown in the U.S. Pat. No. 5,485,877, contain a basket wrapper frame or structure which serves to contain the heat exchange elements, provide structural strength and provide an attachment point for lifting the baskets. While these basket wrap structures are valuable for lifting purposes, they limit the amount of the elements that can be contained within the structure. In addition, the basket wrap structure creates a flow-bypass gap between the element plates and the diaphragms of the rotor structure. This limits the thermal efficiency of the rotor structure for a given size of air preheater.

SUMMARY OF THE INVENTION

The present invention relates to a novel structure for modular heat exchange baskets. The conventional basket wrap members extending radially on the outside of the top and bottom edges of each side of each basket are eliminated and replaced with tie bars which fasten the inner and outer end frames together and which extend radially above and below the heat exchange plates and which are located inside of the side boundaries of the heat exchange plates such that the plates extend all the way out to the side boundaries thereby reducing bypass gaps and increasing the volume of heat transfer surface in relation to the size of the basket. In order to provide for lifting the baskets, the lifting points are moved from the central region of the prior basket-wrapper structure to the inboard and outboard corners of the basket.

DESCRIPTION OF THE PREFERRED EMBODIMENTS

Figure 2:
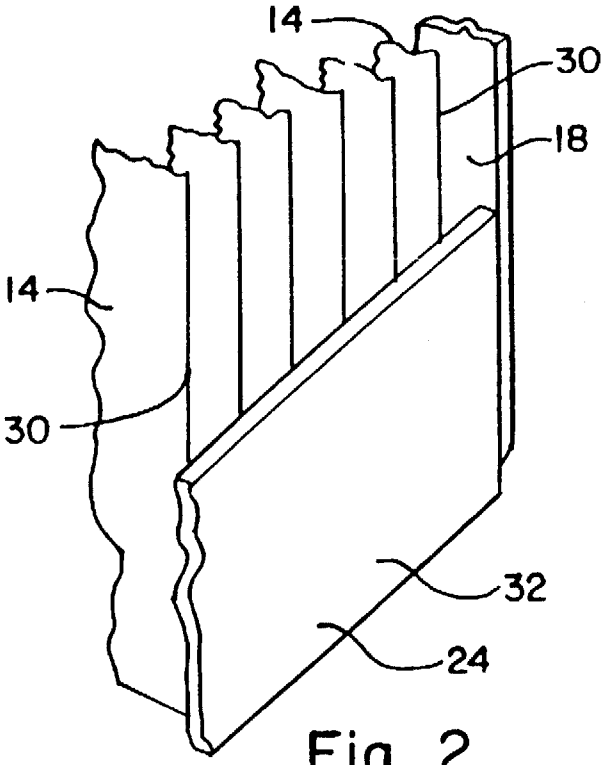
Fig. 2 (PRIOR ART)
FIG. 2 is a more detailed view of one corner of the basket of FIG. 1.
Figure 1:
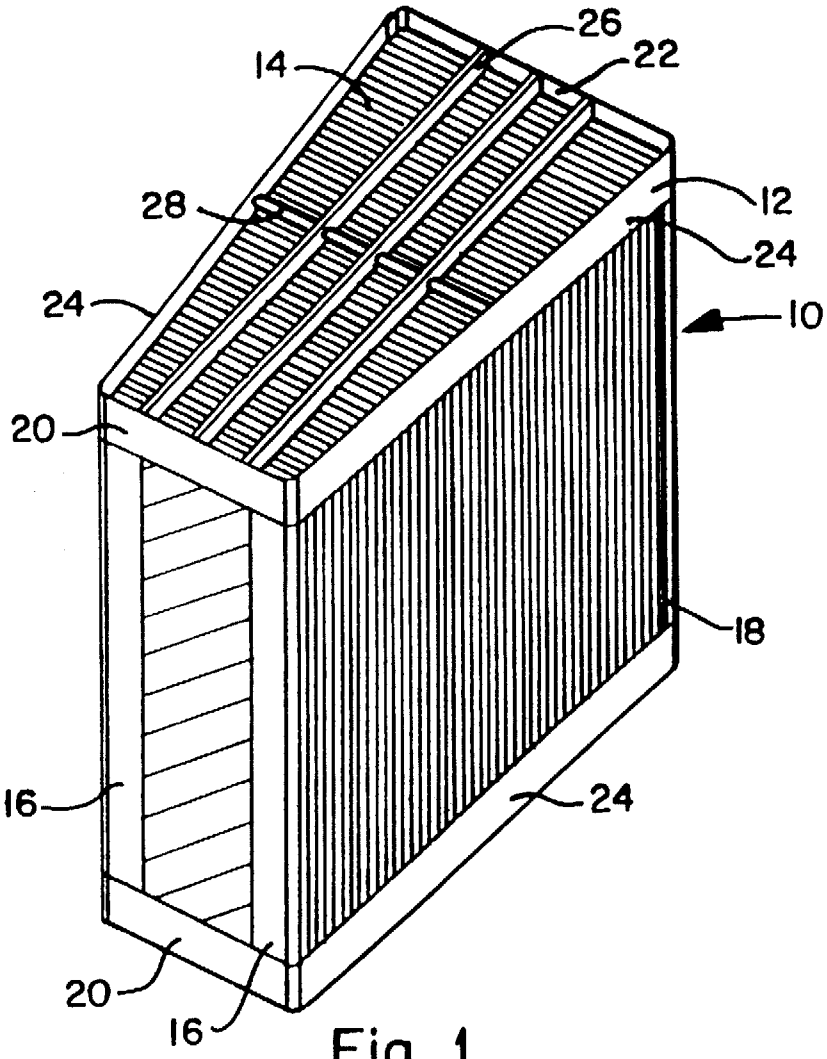
Fig. 1 (PRIOR ART)
FIG. 1 is a general perspective view of a rotary regenerative air preheater basket module with a basket wrapper structure according to the prior art.

FIGS. 1 and 2 show a typical modular heat exchange basket 10 according to the prior art which comprises a basket-wrapper structure 12 inside of which are the individual heat exchange plates 14. The basket-wrapper structure 12 comprises a frame formed from inboard corner pieces 16, outboard corner pieces 18, inboard and outboard cross members 20 and 22 respectively and the radial top and bottom side members 24. The plates 14 are inside of this framework as shown in these FIGS. 1 and 2 and retained in position by the bars 26. There are corresponding bars 26 on the bottom of each basket on which the plates sit. Extending across the top of the baskets is rod 28 attached to the radial top side members 24 and to the bars 26. This rod 28 is usually located in vertical alignment with the center of gravity of the basket and serves as the lifting location for the basket. Since this lifting rod is attached to the upper members 24, the upper members must be substantial structural members in order to be able to support and lift the considerable weight of the entire basket. Therefore, these members 24 have a rather large cross section and, in particular, a rather large vertical dimension as shown most clearly in FIG. 2 with these members 24 extending a substantial distance along the sides of the plates.

As can be seen in these FIGS. 1 and 2, there is a gap between the side edges 30 of the plates 14 and the side periphery of the basket as defined by the outside surface 32 of the radial top and bottom side members 24. This gap can be seen in FIG. 3 which is a plan view of a small section through one sector-shaped compartment of a rotor showing a portion of a prior art basket module 10 according to U.S. Pat. No. 5,485,877 in position between the rotor diaphragms 34. These basket modules are sized and shaped such that the angle of the sector is smaller than the complimentary angle of the basket whereby the outboard end of each basket contacts the diaphragms before the contact of the inboard end. As a result, there is a gap 36 at the inboard end of each basket between the side members 24 and the diaphragms 34. Since the side members 24 are outside of the plates, the resulting gap 38 formed between the edges 30 of the of the plates 14 and the diaphragms 34 is significantly larger than the gap 36. While the basket-wrapper structure of the prior art shown in these FIGS. 1, 2 and 3 serves to contain the plates and to provide a solid structure and attachment point for the basket lifting bar 28, it limits the amount of plate material that can be contained within the basket frame. In addition, it creates a flow-bypass gap which limits the thermal efficiency.

Figure 3:
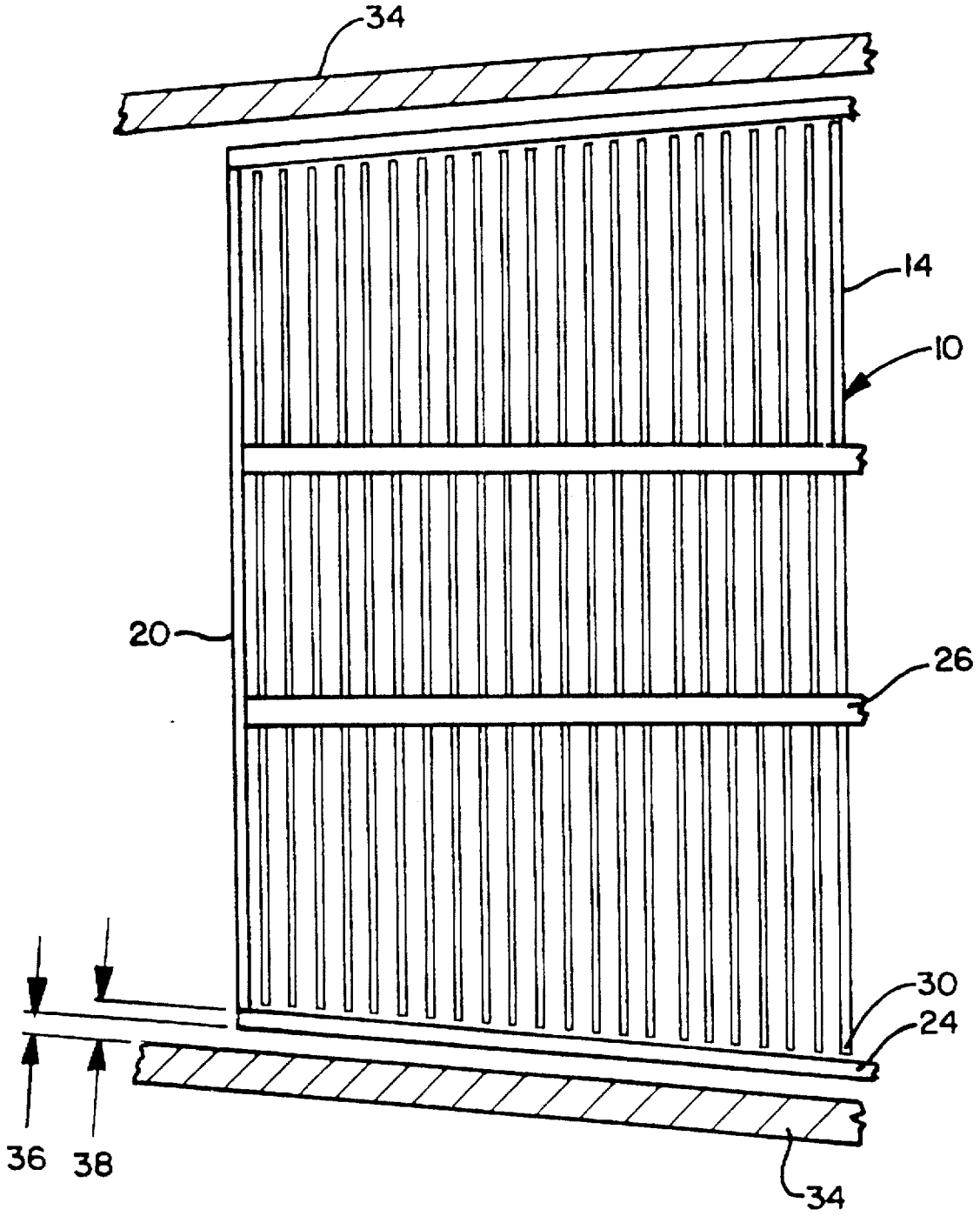
Fig. 3 (PRIOR ART)
FIG. 3 is a plan view of a small section through one sector-shaped compartment of a rotor showing a portion of a prior art basket module.
Figure 5:
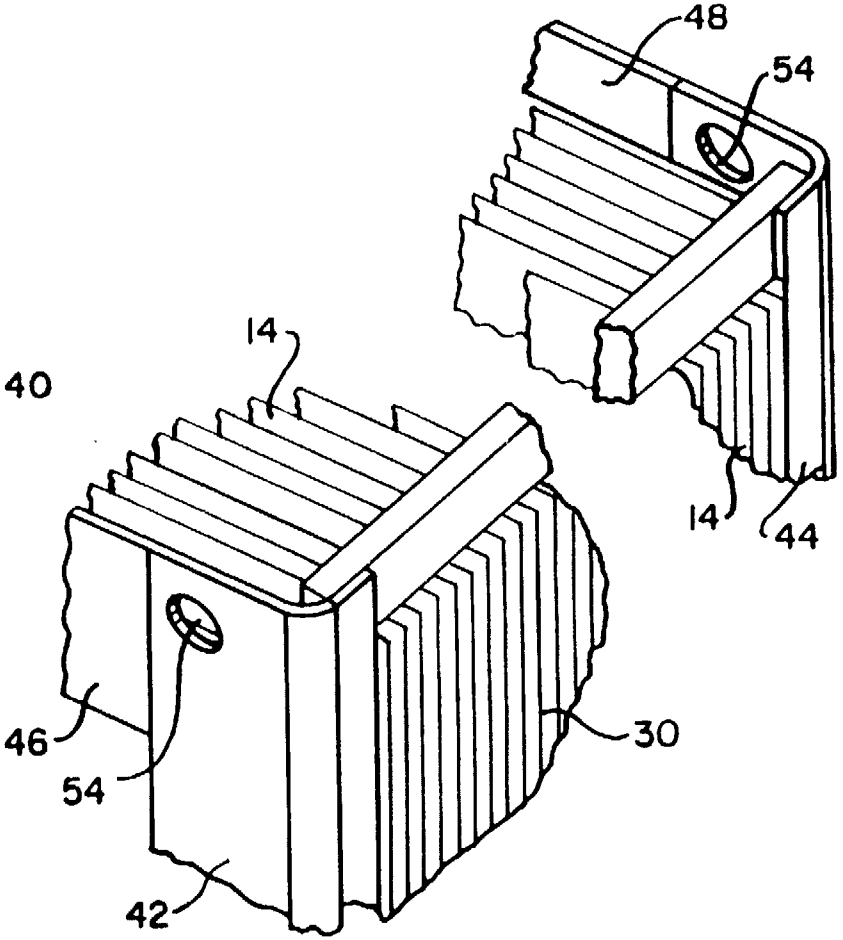
FIG. 5 is a more detailed view of one of the corners of the basket of FIG. 4.
Figure 4:
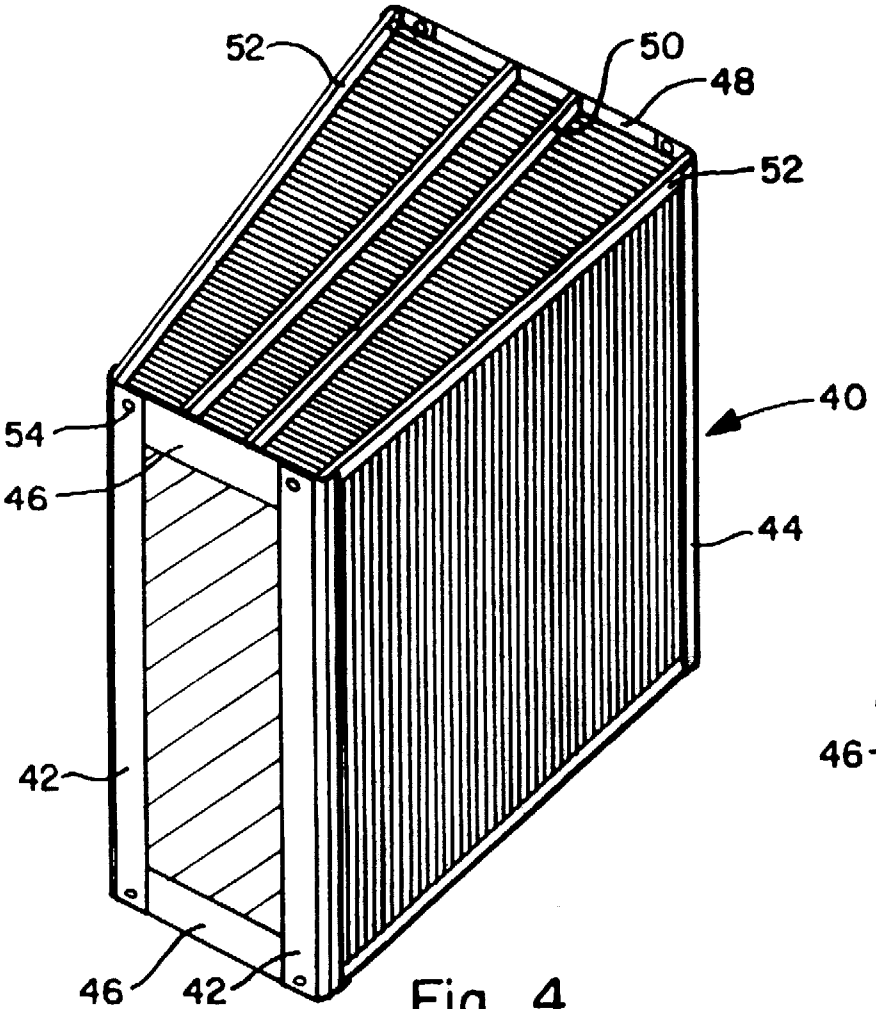
FIG. 4 is a general perspective view of a basket according to the present invention.
Figure 6:
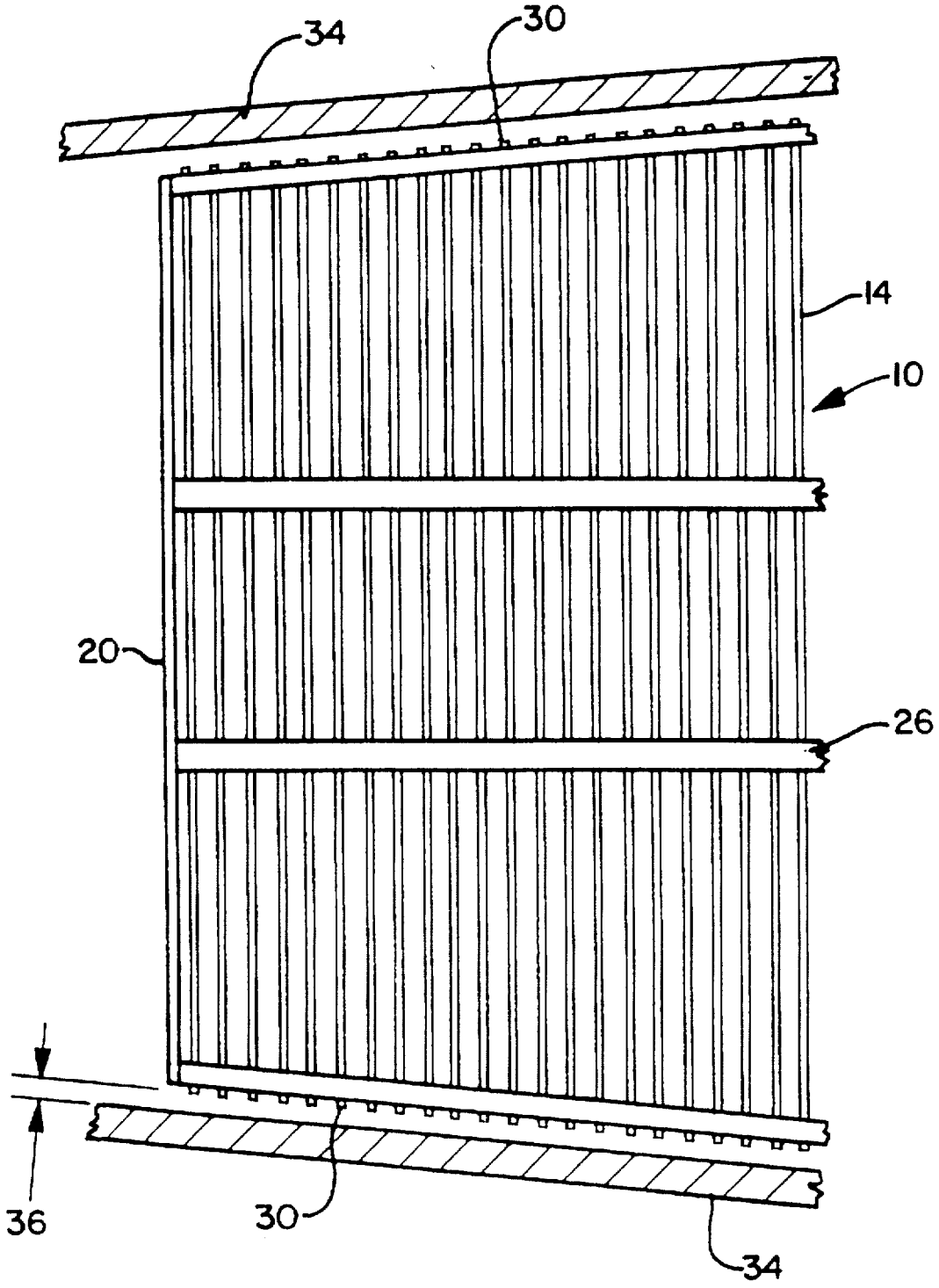
FIG. 6 is a plan view of a small section through one sector-shaped compartment of a rotor showing a portion of a basket module according to the invention.

Turning now to FIGS. 4, 5 and 6, the modular heat exchange basket 40 comprises a frame formed from the inboard corner pieces 42, outboard corner pieces 44 and inboard and outboard cross members 46 and 48 respectively. These frame members are all similar to the corresponding frame members of the prior art baskets as shown in FIGS. 1, 2 and 3. The basket 40 also has bars 50 which correspond to the bars 26 in FIG. 1. However, the basket 40 does not have components equivalent to the radial top and bottom side members 24 or the lifting rod 28.

As shown most clearly in FIG. 5, the side edges 30 of the plates 14 in the basket 40 fully extend out to and now define the side periphery of the basket. In this arrangement, instead of the radial side members 24, there are now merely the small bars 52 which are essentially the same as the bars 50. As shown, these bars 52 are inside of the side edges 30 of the plates 14. The gap between the side edges 30 of the plates 14 and the diaphragms 34 is shown in FIG. 6 and is the distance 36 rather than the distance 38 of the prior art shown in FIG. 3.

Because the structural radially side members 24 are no longer present, there is no comparable structural member which would support a lifting rod such as the lifting rod 28. Therefore, in the present invention, the arrangement for lifting the basket is switched to the holes 54 located at each upper corner of the basket in the corner pieces 42. Holes 54 are also located at each lower corner for reversibility. This provides rigid points for lifting and eliminates the need for the structural rigidity of the basket wrapper structure of the prior art. The pressure between the plates created by packing the plates into the frame and the resulting friction between the plates will hold the plates in position and prevent them from slipping sideways.

This basket design increases the heat transfer volume for a particular size rotor as well as decreasing the available flow-bypass gaps. The net result is increased thermal performance and the possible selection of a smaller, less expensive air preheater for a given application. Also, the manufacturing cost is lower than the prior art design.

I claim:

1. A heat transfer element basket assembly for a rotary regenerative heat exchanger comprising:

a) a basket framework including an inboard end frame and an outboard end frame, said inboard and outboard end frames including corner pieces defining side edges of said basket framework;

b) a stack of a plurality of heat exchange plates stacked adjacent to each other between said inboard end frame and said outboard end frame, said stack of heat exchange plates having a top edge, a bottom edge and side edges and wherein said side edges of said stack extend out beyond said side edges of said basket framework;

c) radially extending horizontal tie bars each extending between and having one end attached to said inboard end frame and the other end attached to said outboard end frame, said tie bars extending across the top and bottom edges of said stack and being positioned adjacent to but inside of said side edges of said stack and said basket framework, whereby said side edges of said stack extend out beyond said side edges of said basket framework.

2. A heat transfer element basket assembly as recited in claim 1 and further including additional bars connecting said inboard end frame to said outboard end frame, said additional bars extending across the top and bottom edges of said stack and being positioned between said tie bars.

3. A heat transfer element basket assembly as recited in claim 1 and further including lifting points located in said corner pieces of said inboard and outboard end frames.

* * * * *